US005819715A

United States Patent [19]

Haneda et al.

[11] Patent Number: 5,819,715

[45] Date of Patent: Oct. 13, 1998

[54] BULLET SHOOTING APPARATUS, BULLET SUPPLY APPARATUS, AND BULLET SHOOTING SYSTEM COMPRISING THESE APPARATUSES

[75] Inventors: Hisatsugu Haneda, 25 W. Highland Dr. #33, Seattle, Wash. 98119; Hiroyuki Kato, Tokyo; Masaru Suzuki, Nerima-ku, both of Japan

[73] Assignee: Hisatsugu Haneda, Seattle, Wash.

[21] Appl. No.: 537,662

[22] PCT Filed: Apr. 8, 1994

[86] PCT No.: PCT/JP94/00591

§ 371 Date: Oct. 5, 1995

§ 102(e) Date: Oct. 5, 1995

[87] PCT Pub. No.: WO94/24509

PCT Pub. Date: Oct. 27, 1994

[51] Int. Cl.[6] ..... F41B 3/04

[52] U.S. Cl. ..... 124/6

[58] Field of Search ..... 124/6

[56] References Cited

U.S. PATENT DOCUMENTS

| | | | |
|---|---|---|---|
| 1,201,626 | 10/1916 | Reynolds | 124/6 |
| 1,408,137 | 2/1922 | Parsons | 124/6 |
| 1,662,629 | 3/1928 | Baden-Powell | 124/6 |
| 2,684,062 | 7/1954 | Rose | 124/6 |
| 4,632,086 | 12/1986 | Rutten | 124/6 |

FOREIGN PATENT DOCUMENTS

| | | | |
|---|---|---|---|
| 794349 | 2/1936 | France | 124/6 |
| 87964 | 1/1896 | Germany | 124/6 |
| 329550 | 9/1935 | Italy | 124/6 |
| 20363 | of 1914 | United Kingdom | 124/6 |
| 526908 | 9/1940 | United Kingdom | 124/6 |

*Primary Examiner*—John A. Ricci
*Attorney, Agent, or Firm*—Seed and Berry LLP

[57] ABSTRACT

The apparatus according to the invention comprises an acceleration barrel (29); a bullet supply apparatus (42) for supplying bullets (46) to the acceleration barrel (29); and a rotor (30) for shooting a bullet (46) in the acceleration barrel (29) from a bore placed at the end of the shooting barrel (18) by directly pushing the bullet (46). Therefore, the present invention provides a bullet shooting apparatus, a bullet supply apparatus, and a bullet shooting system comprising these apparatuses, wherein bullets can be shot consecutively at a high speed, and at a high initial shooting speed, without using compressed gas, and without causing energy loss.

13 Claims, 21 Drawing Sheets

(1)

(2)

BULLET SHOOTING APPARATUS, BULLET SUPPLY APPARATUS, AND BULLET SHOOTING SYSTEM COMPRISING THESE APPARATUSES

FIELD OF THE INVENTION

This invention relates to a bullet shooting apparatus, a bullet supply apparatus, and a bullet shooting system comprising these apparatuses, and in particular, relates to a bullet shooting apparatus, a bullet supply apparatus which supplies a bullet to the bullet shooting apparatus, and a bullet shooting system comprising these apparatuses, to be used for toy guns.

PRIOR ART

A conventional bullet shooting apparatuses in the field of toys, i.e., toy guns, includes an apparatus which shoots a bullet by using pressure generated from the compression of air or other gas, such as freon gas, carbon dioxide or LP gas, and an apparatus which shoots a bullet by using a rubber piece or spring.

However, in a toy gun which shoots a bullet by using compressed air, the compressed air is transferred to the bullet by a bullet shooting piston for each bullet to be shot, and a movement to pull the piston (hereinafter referred to as "cocking") is required. As a result, it is difficult to shoot consecutive shots.

Concerning a toy gun which shoots a bullet by using a gas other than air, such as freon gas or carbon dioxide, the vaporization ratio of the gas varies, depending on the temperature, and thus the initial shooting speed and the speed of consecutive shots will also vary, depending on the temperature. In extreme cases, the bullet cannot be launched because of the liquefaction of the gas. Furthermore, freon, the preferred gas to be used in such an apparatus, will be abolished for environmental protection reasons.

In order to improve the weak points in a toy gun which uses compressed air (as described above), a toy gun comprising a tank filled with compressed air, whereby a bullet is shot by using the compressed air, has been proposed. However, this kind of toy gun has various problems, ie., the toy gun must be accompanied by a large, heavy tank.

In order to solve the above problems, a toy gun comprising a motor driven by a battery, whereby the cocking mechanism can be continuously driven, allowing bullets to be shot consecutively, has been recently proposed.

SUMMARY OF INVENTION

All of the above conventional toy guns shoot bullets by using a cocking mechanism, and the speed of consecutive shots (number of bullets shot per unit-hour) depends on the cocking mechanism. Moreover, because the rotation of the motor driven by electricity is converted into the reciprocating motion of the piston, a problem arises in that the initial shooting speed is lower than its theoretical value, due to energy loss.

Another problem arises in that the shooting range is insufficient because a plastic bullet shot from a toy gun drops too soon, due either to air resistance or the light weight of the bullet.

The objective of the present invention is to provide a bullet shooting apparatus, the speed of consecutive shots and initial shooting speed of which is high, without using compressed gas, and without suffering from energy loss. Another objective of the present invention is to provide a bullet shooting apparatus that is capable of extending the shooting range. Another objective of the present invention is to provide a bullet supply apparatus which may efficiently supply a bullet to the bullet shooting apparatus. Another objective of the present invention is to provide a bullet shooting system, comprising a bullet shooting apparatus and a bullet supply apparatus according to the present invention.

In order to achieve the aforementioned objectives, the present invention is characterized as a bullet shooting apparatus comprising a barrel, a bullet supply mechanism for supplying bullets to the barrel, and a rotating means for rotating the inside of the barrel and shooting a bullet from the bore located at the end of the barrel, by directly pushing the bullet into the barrel.

The barrel should preferably be curved. Particularly, the barrel should preferably be formed in a helix (swirling) shape. The barrel should also preferably have a helix at the portion adjacent to the starting point, and should continue from the portion of the helix where the diameter is largest, and has a linear shape at the portion adjacent to the bore. Also, the section adjacent to the starting point of the barrel should preferably be a helix, and the section adjacent to the bore of the barrel should preferably be curved, and should connect with the helix at the location where the diameter of the helix is largest and curves away from the helix. The most preferable helix for this application would be a logarithmic spiral (a helix whose radius vector is expressed as an exponential function of the rotating angle). Moreover, the bullet supply mechanism should preferably supply a bullet to the starting point of the barrel. Also, the rotating apparatus should preferably revolve around the starting point.

The bullet supply mechanism described above should preferably comprise: a rotating vessel; an opening placed on the vessel, the diameter of which increases the closer it is to the barrel, and is in communication with the barrel; and should preferably supply the bullet stored in the vessel to the barrel through the opening.

The present invention is further characterized in that a bullet shooting apparatus comprises: a barrel for shooting a bullet from the bore; and a bullet supply apparatus for supplying a bullet to the barrel, the barrel having a curved shape.

The rotating means should preferably comprise: a rotating drum, cylindrical in shape, which extends in the longitudinal direction of the barrel, and rotates around the longitudinal axis; and a groove provided on the side of the rotating drum and in which a bullet may be inserted. Moreover, the groove should preferably comprise a helix, the diameter of which widens towards the bore. Also, the rotating drum should preferably be tapered from either end. Several rotating drums should be provided, so that the grooves of each rotating drum face each other.

The present invention is characterized by a bullet supply apparatus comprising a magazine, a bullet path to guide a bullet from the magazine to the bullet shooting apparatus, and a bullet introduction rotating means which rotates and introduces a bullet from the magazine to the bullet shooting apparatus through the bullet path.

The bullet introduction rotating means preferably comprises: a rotating vessel, and an opening provided on the vessel, the diameter of which increases the closer it is to the bullet path, and which is in communication with the bullet path, which supplies the bullet stored in the vessel to the bullet path through the opening. The apparatus should also comprise several openings.

The present invention is characterized by a bullet shooting system, comprising a bullet shooting apparatus according to the present invention, and a bullet supply apparatus according to the present invention, wherein a bullet is introduced from the magazine to the bullet shooting apparatus. This bullet shooting system should preferably comprise a detection means for detecting a target, a data processing means for forming a control signal, based on the output signal, from the detection means, and outputting the control signal to the rotating means. The data processing means should most preferably output the control signal to the bullet introduction rotating means.

According to the bullet shooting apparatus of the present invention, a bullet launches out the bore, having been directly pushed by a rotating body, so that the conversion of the rotating motion of the motor (generated by electricity) to reciprocation of the piston is not required, and thus energy loss is reduced. Therefore, the speed of continuous shots, and the initial shooting speed in relation to energy used can be increased. Since compressed gas is not used, the apparatus may be formed with a simple configuration, without requiring a tank or other apparatus, for storing the compressed gas.

Because a bullet can be shot according to the rotating speed of the rotating body, the speed of consecutive shots is not restricted by the cocking mechanism. Therefore, the speed of consecutive shots can be increased.

Because the shape of the barrel is curved, the bullet rolls along the wall of the barrel by the centrifugal force generated when the bullet passes through the inside of the barrel. Due to the centrifugal force, an upward spin is added to the bullet, the lifting force increasing the flying distance of the bullet. This effect can be further enhanced by forming the barrel in a helix shape, and can be enhanced still further by using a logarithmic spiral. If the curved shape of the barrel can be varied, the acceleration properties of the bullet within the barrel can be set. Moreover, the acceleration of the bullet can be increased by forming the barrel so that it has a helix at the portion adjacent to the starting portion, and continues from the portion of the helix where the diameter is largest, and has a linear shape at the portion adjacent to the bore. Further, the acceleration of the bullet can further be increased by shaping the barrel in a helix at the section adjacent to the starting point, and in a curve at the point adjacent to the bore, and by connecting the barrel to the portion of the helix where the diameter is largest, such that it curves away from the helix.

By supplying the bullet at the starting point of the barrel, the distance which the bullet rolls along the wall of the barrel can be extended so that the upward spin applied to the bullet becomes stronger. As a result, the flying distance of the bullet can be increased. This operation can be enhanced further by rotating the rotating means around the starting point.

According to the bullet shooting apparatus of the present invention, a bullet passes through the barrel in contact with a groove provided in a rotating drum. Therefore, even though the barrel has a linear shape, the force generated by the rotation of the rotating drum, i.e., the force to cause a bullet to move forward, can be applied to a bullet as it passes through the barrel. Furthermore, by varying the rotation of the rotating drum, the acceleration properties of the bullet in the barrel can be set.

The groove in the rotating drum becomes wider towards the bore so that the acceleration of the bullet passing through the barrel can increase, even though the rotation speed of the rotating drum remains the same, and thus, the bullet may launch out at a faster speed. As the rotating drum is tapered from either end, the acceleration of the bullet passing through the barrel can be further increased even though the rotation speed of the rotating drum is the same.

Several rotating drums are provided, such that the grooves of each rotating drum face each other, thereby allowing the bullet to pass through the barrel in contact with the groove within the rotating drum. While the bullet is passing through the barrel, the lateral rotation applied to the bullet can be set off by setting the rotation conditions for each rotating drum.

According to the bullet supply apparatus of the present invention, the bullet is introduced to the bullet shooting apparatus by being pushed by the bullet introduction rotating means. Therefore, the rotating force of the bullet introduction rotating means is applied to the bullet, such that the bullet is promptly introduced to the bullet shooting apparatus, and thus, the speed of consecutive shots from the bullet shooting apparatus can be increased.

The diameter of the bullet introduction rotating means increases the closer it is to the bullet path, and supplies the bullet into the bullet path through the opening, which is in communication with the bullet path, so that the bullet can be smoothly supplied to the path, in addition to the operation described above. Also, several openings are provided, so that the bullet can be supplied to the bullet path more quickly; even in the case of a problem occurring, such as blockage of part of an opening, the bullets can be supplied to the bullet path through one of the other openings.

The bullet shooting system of the present invention comprises: the bullet shooting apparatus of the present invention, and the bullet supply apparatus of the present invention, such that a series of operations from the supply of the bullet to the shooting of the bullet can be efficiently implemented, and synergism between the two apparatuses can be achieved. The bullet shooting system comprises a detection means for detecting the target, and a data processing means for forming a control signal based on the output signal from the detection means, and transmitting the control signal to the rotating means, such that the bullet can be shot at the target at a constant power, regardless of the shape, size or kind of the target. Also, the bullet can be shot with certainty even if the target moves. The data processing means outputs the control signal to the bullet introduction rotating means, such that shooting with a constant power is achieved.

DETAILED DESCRIPTION OF PREFERRED EMBODIMENTS

Figure 1:
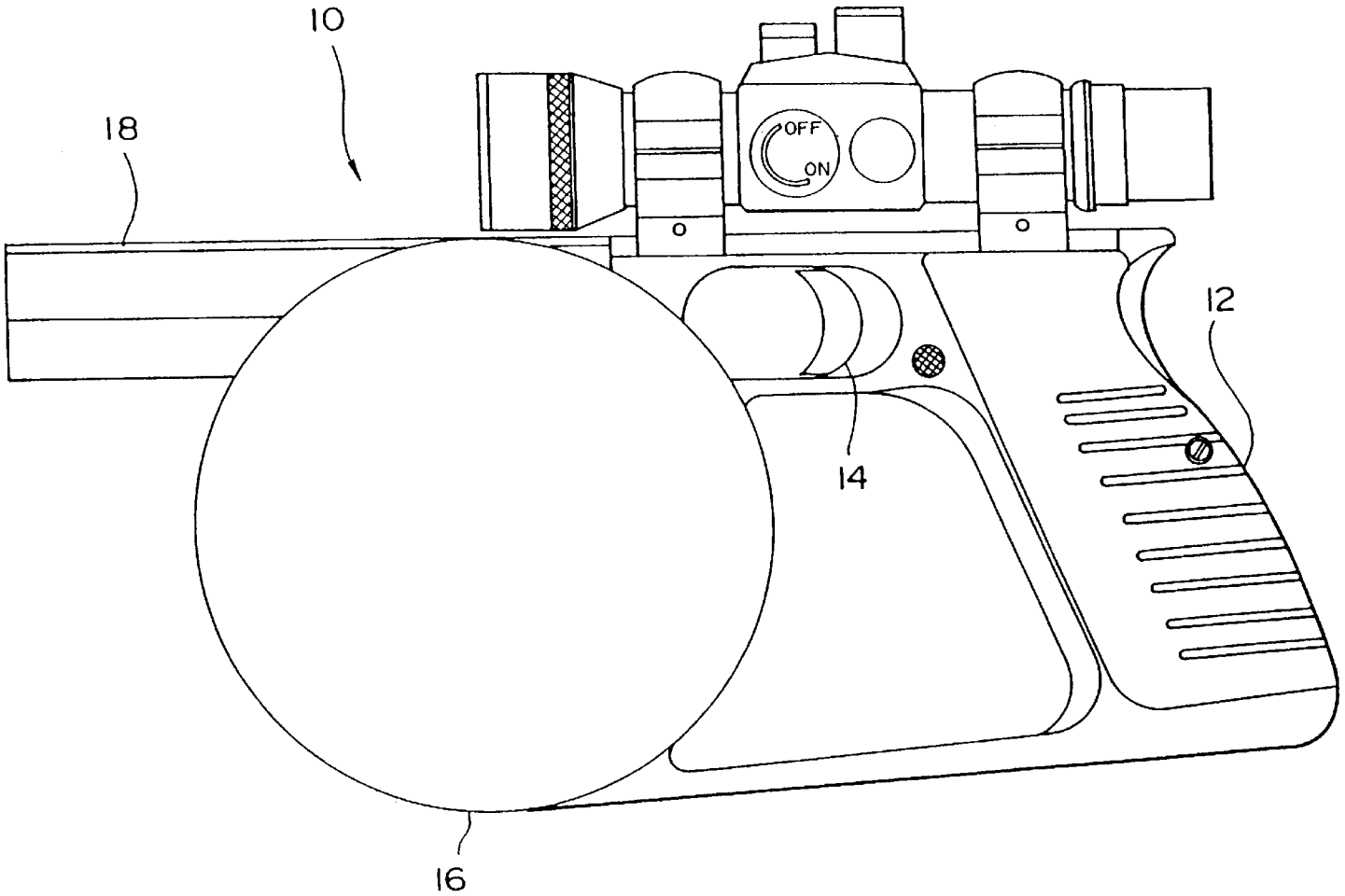
FIG. 1 is a front view of the toy gun to which the bullet shooting apparatus of the present invention is applied.
Figure 2:
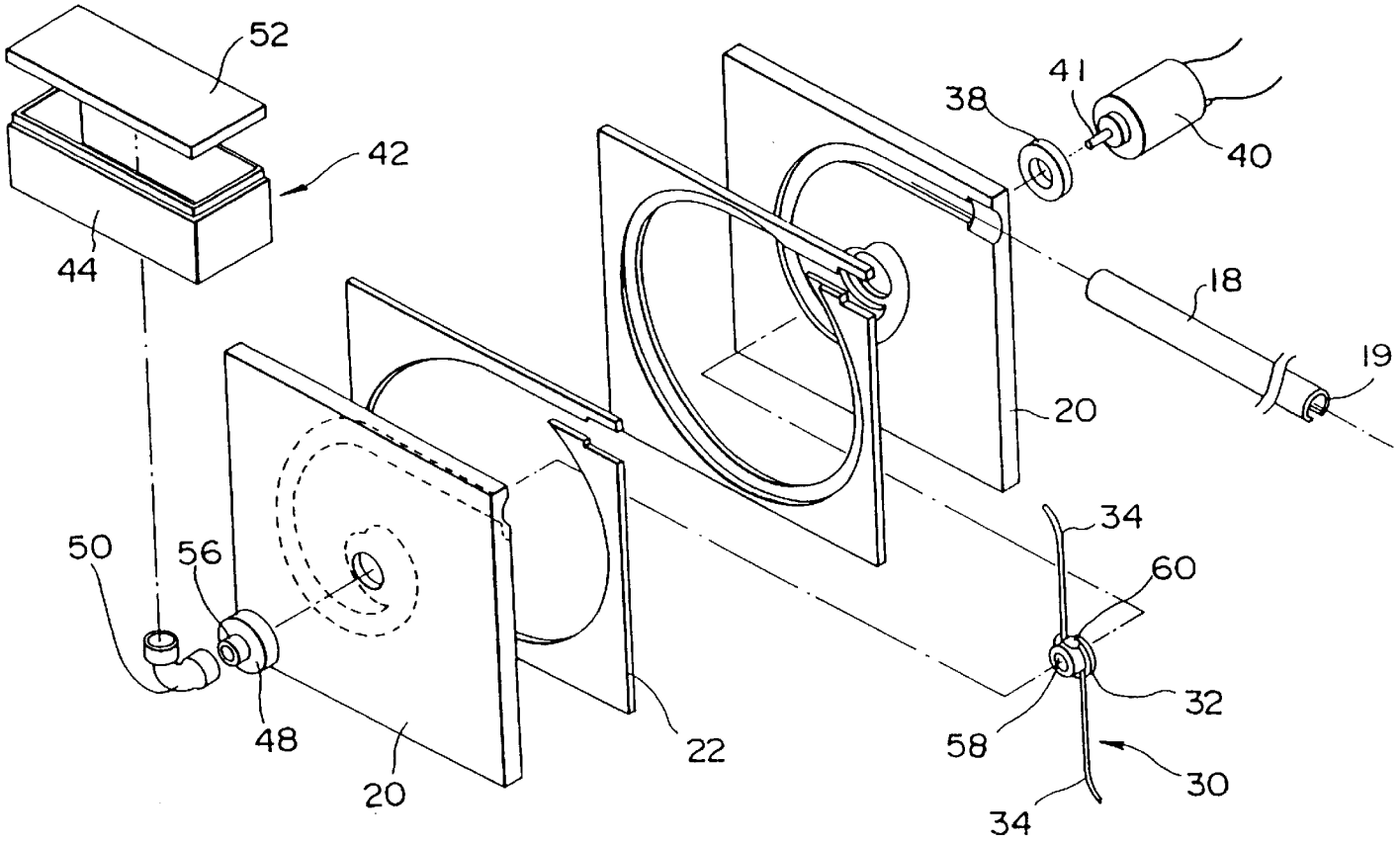
FIG. 2 is an exploded view of the first embodiment of the shooting apparatus of the present invention.

The preferred embodiments of the invention will now be described with reference to the accompanying drawings. FIG. 1 is a front view of the toy gun in which the bullet shooting apparatus, according to the first embodiment of the invention, is supplied. FIG. 2 is a divided assembly view of the shooting apparatus, FIG. 3 is a front cross section of the shooting apparatus shown in FIG. 2, and FIG. 4 is a VI—VI cross sectional view of FIG. 3.

A toy gun 10 shown in FIG. 1 is shaped as a pistol, and launches out a light weight plastic bullet, not shown in the drawing.

The toy gun 10 comprises a grip 12 comprising a battery for supplying electricity to the shooting apparatus discussed below, a trigger 14, a shooting apparatus 16 comprising a shooting mechanism inside, and a shooting barrel 18 for launching a bullet from the barrel in the shooting apparatus 16.

Figure 3:
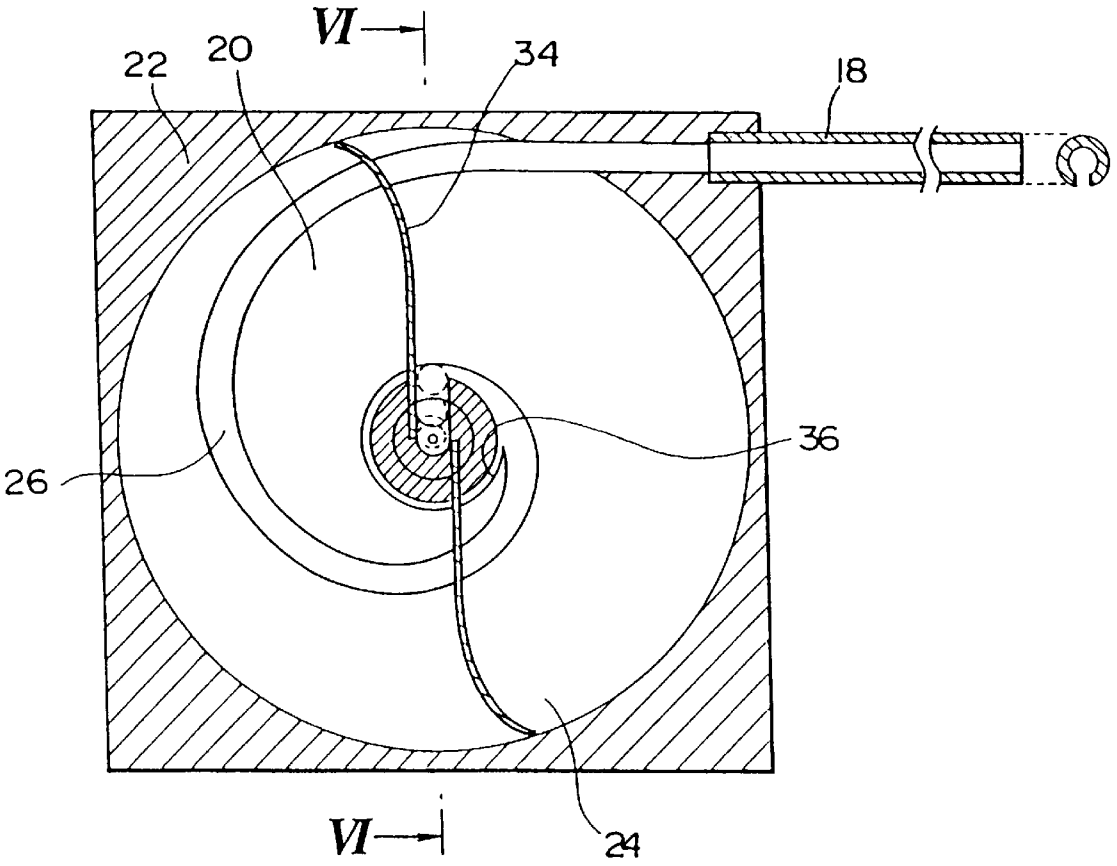
FIG. 3 is a cross sectional view (cut in a plane direction) of the first embodiment of the shooting apparatus of the present invention.
Figure 4:
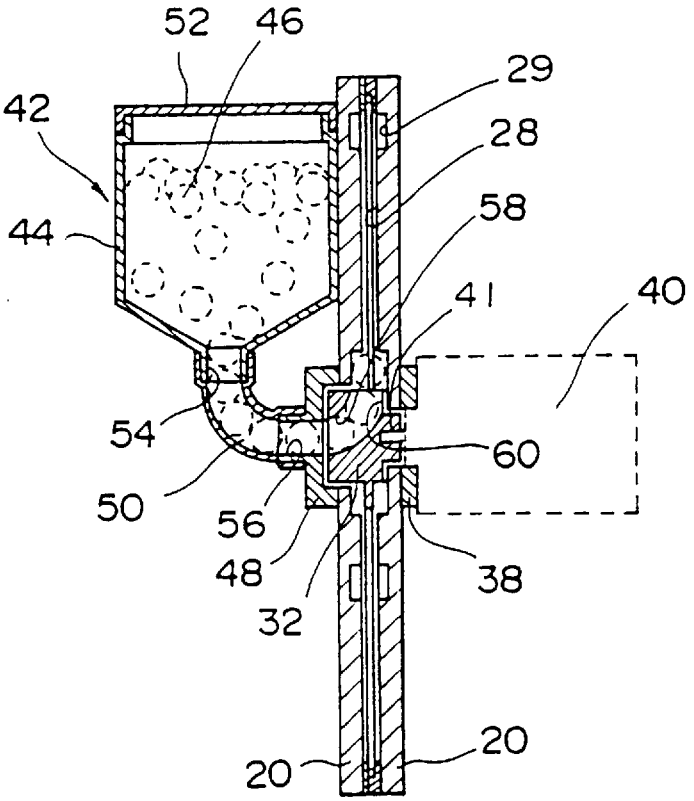
FIG. 4 is a VI—VI cross section of FIG. 3.

As shown in FIGS. 2 through 4, the shooting apparatus 16 has two bullet guide plates 20, rectangular shaped, which are assembled together by an attaching means, such as a bolt or adhesive, placing a spacer plate 22 in between, having a circular gain at its center. In the bullet guide plate 20, a groove 26 (FIG. 3) is provided (in a curve shape, a helix, in particular) for the introduction of a bullet to the shooting barrel 18 (the cross section of which is rectangular).

Upon the assembly of the two bullet guide plates 20 providing the spacer plate 22 in between, a circular space 28 (as specifically shown in FIG. 4) with a constant width is formed between the bullet guide plates 20. In the circular space 28, freely rotatable blades 34 are provided for a rotor unit 30, a rotating means for pushing the bullet, as discussed in detail below. Also, the grooves 26 on the two bullet guide plates 20 face each other (engage) to form an acceleration barrel 29 (FIG. 4), extending in a helix from the center of the bullet guide plates 20 to the shooting barrel 18, the cross section of which is a rectangle.

The rotor unit 30 consists of a center body 32, cylindrical in shape, and two rotors 34 attached to the center body in point symmetry with each other. The rotors 34 are in contact with the center body 32. Each rotor 34 curves towards the direction opposite the rotating direction of the rotor unit 30 at its top end, and is configured to rotate uniformly with the center body 32.

At the terminating end of the acceleration barrel 29 (FIG. 4), the bore 19 (FIG. 2), has an opening on its lower part (the width of which is constant in the direction of its axis), which is continuously attached to the shooting barrel 18. The starting point of the groove which forms the acceleration barrel 29 is a circular opening 36 with a circular space. The center body 32 is connected within the opening 36.

A motor 40 is attached perpendicularly to one of the bullet guide plates 20, with a spacer 38 placed in between. A rotating axis 41 is in direct contact with the center body 32 of the rotor unit 30. The bullet supply apparatus 42 for supplying a bullet to the starting position of the acceleration barrel 29 is provided on the bullet guide plate 20 onto which the motor 40 is not attached. The bullet supply apparatus 42 includes a magazine 44, comprising several light weight plastic bullets, a bullet supply head 48 for supplying the spherical bullet 46 (made of light weight plastic) stored in the magazine 44 to the center body 32, and a direction changing tube 50 for guiding the bullet 46 from the magazine 44 to the bullet supply head 48. The numeral 52 illustrates the cover of the magazine 44.

The magazine 44 is attached, or preferably secured, to the side surface of the bullet guide plate 20 onto which the motor 40 is not attached. The cross section of the magazine 44 is shaped like a millstone, and an outlet 54 is formed at the center of the bottom surface of the magazine 44, to launch the bullet 46. The direction changing tube 50 is in contact with the outlet 54 for the bullet 46, and the tube 50 curves in the direction of the main body of the shooting barrel 18 and its terminating end is in contact with the periphery of the bullet supply opening 56 of the bullet supply head 48.

The center body 32 comprises an entrance opening 58 for receiving the bullet 46 from the bullet supply head 48, and an exit opening 60 in communication with the entrance opening 58 (at a right angel) to eject the bullet 46 from the center body 32 to the -starting position of the acceleration barrel 29 (26). The entrance opening 58 opens towards the direction of axis of the center body 32, and the exit opening 60 opens towards the direction of the diameter of the center body 32.

The operation of the toy gun according to the first embodiment is described below. When the magazine 44 of the toy gun 10 of the first embodiment is filled with the bullets 46, a bullet 46 moves downward from the exit opening 54 of the magazine 44 by gravity, through the direction changing tube 50, and is transferred through the bullet supply head 48 and the entrance opening 58 to the center body 32.

When the trigger 14 of the toy gun 10 is pulled, electricity is supplied from the battery (not shown) to the motor 40, and the rotor unit 30 uniformly rotates with the motor 40. At this time, the bullet within the center body 32 is moving in the direction outward from the center due to centrifugal force, and when the exit opening 60 of the center body 32 matches the outlet of the acceleration barrel 29 (26), the bullet 46 is delivered from the center body 32 to the acceleration barrel 29. The bullet 46 delivered to the acceleration barrel 29 is directly pushed by the rotor 34 placed immediately behind the exit opening 60 within the acceleration barrel 29 (26), and is launched from the shooting barrel 18 along its axis.

The speed of the bullet 46 delivered from the center body 32 to the acceleration barrel 29 is almost zero at the beginning of this process, and gradually accelerates within the acceleration barrel 29, being pushed by the rotor 34 to its final speed, which is obtained by multiplying the radius by the angular speed of the rotor unit, at which point the bullet is launched from the shooting barrel 18.

The acceleration barrel 29 is curved, i.e., formed to be a helix, such that the bullet 46 passing through the acceleration barrel 29 rolls in contact with the wall of the acceleration barrel by centrifugal force. As a result, an upward vertical spin is applied to the bullet launched out of the bore 19 through the shooting barrel 18.

Figure 5:
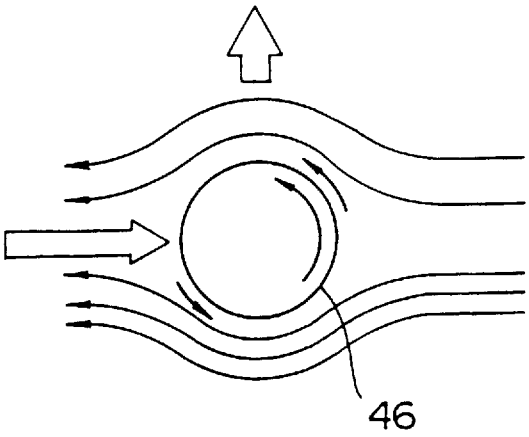
FIG. 5 is a diagram illustrating the motion of the bullet launched from the shooting apparatus of the present invention.
Figure 5:
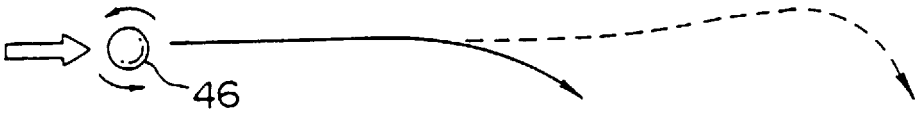

In other words, as shown in FIG. 5 (1), if an upward vertical spin is applied to the bullet 46, a lifting force is generated, and thus the flying distance of the bullet 46 is increased as shown in FIG. 5 (2). If the upward spin is too fast, then the bullet 46 is likely to move upward departing from its trajectory, and if this spin is too slow, the flying distance of the bullet 46 will be shorter. As a result of our thorough research, we discovered that if the shape of the acceleration barrel 29 is a helix, a logarithmic spiral (a helix whose radius vector is indicated by an exponential function) in particular, a preferable upward spin and longer maximum flying distance can be achieved. Materials which achieve a preferable friction should be used to construct the acceleration barrel 29, specifically, materials such as metals, including duralmin and brass, or Teflon coated/otherwise processed metals or resins.

The bullet path should be arranged in accordance with the process of the bullet 46 passing through the acceleration barrel 29, and thus it is not necessary to manufacture the shooting barrel 18 to correspond to the size of the bullet 46, as in the prior art. In other words, in the conventional shooting barrel, if the diameter of the barrel is too large for the bullet, then the bullet shifts within the barrel, and the bullet path becomes unstable, and furthermore, the gas used for shooting the bullet escapes from the space between the bullet and the width of the barrel, as a result of which the initial speed deteriorates, and an unstable spin is applied to the bullet. On the other hand, if the diameter of the barrel is too small, the bullet may get jammed. Therefore, it is necessary to manufacture the barrel accurately so that the barrel fits with the diameter of the bullet. However, according to the present invention, it is not necessary to form the barrel to correspond exactly to the diameter of the bullet 46, as in the prior art, because the bullet path is arranged according to the bullet 46 rolling along the wall of the acceleration barrel 29 by centrifugal force, and no compressed gas is used for shooting the bullet 46.

According to the first embodiment, the rotor 34, a rotating part, directly pushes the bullet 46, so that energy loss is very limited, and thus the speed of consecutive shots and the initial shooting speed can be increased, and the stability of the bullet path will be enhanced. Because no compressed gas is used, the objectives of the invention can be achieved with a simple structure, (not requiring a tank, etc. for storing compressed gas). Also, as the bullet 46 is shot based on the rotating speed of the center body 32, increasing the speed of consecutive shots and the initial shooting speed of the bullet 46 is not restricted by the cocking mechanism.

According to the first embodiment, the speed of the bullet 46 supplied to the acceleration barrel 29 continuously accelerates from zero to the speed obtained by multiplying the angular speed of the rotor unit 30 by the diameter of the acceleration barrel 29. In the prior art, the acceleration of the bullet was particularly unstable. In this embodiment, an ideal bullet shooting pattern, i.e., smooth linear acceleration of the bullet 46, can be achieved, and a stable initial speed can also be obtained.

Figure 6:
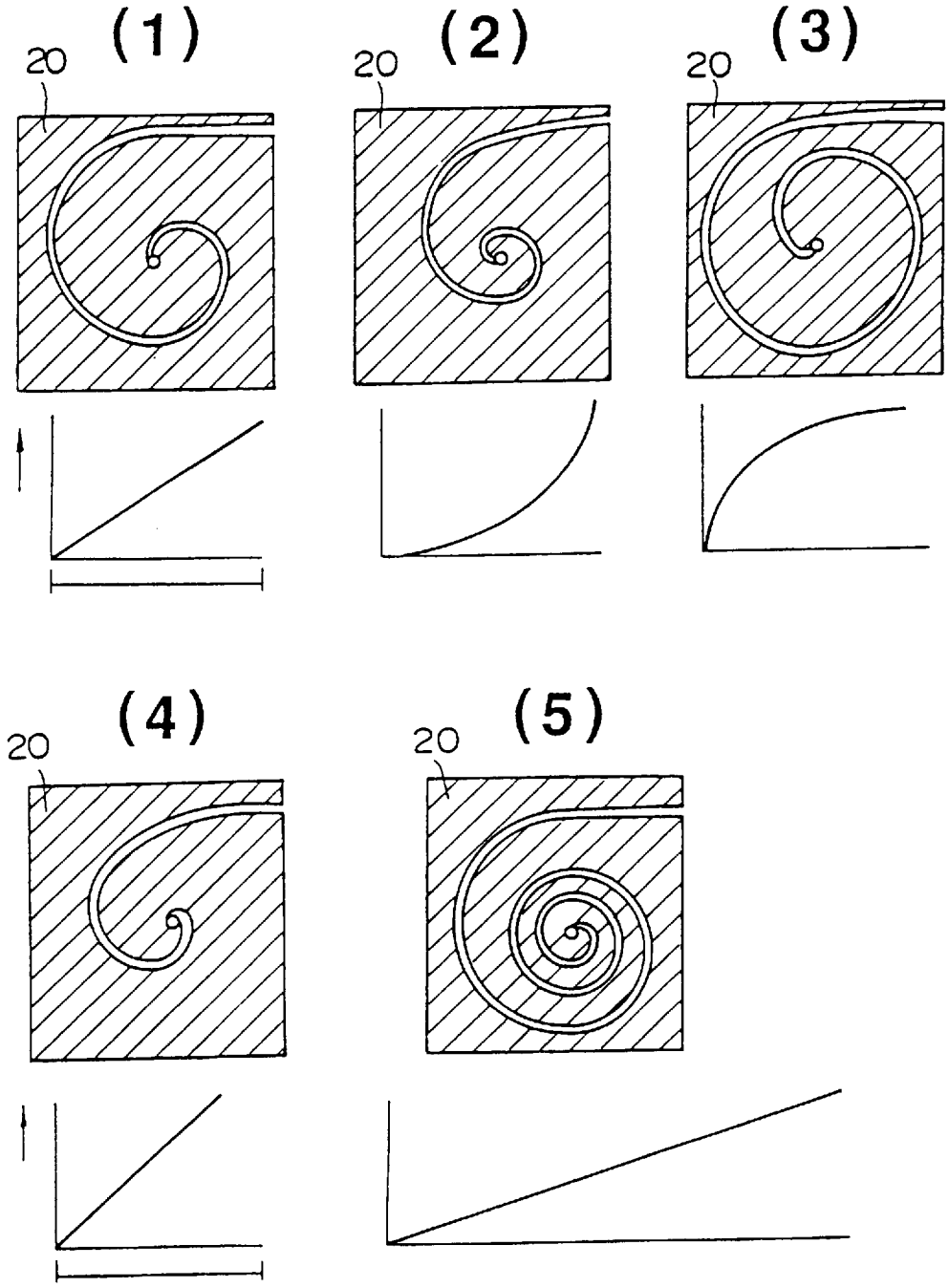
FIG. 6 is a drawing illustrating a specific example of helix barrels included in the shooting apparatus of the present invention.

FIG. 6 is a characteristic drawing illustrating the relationship between the shape of the acceleration barrel 29 and the speed of bullet. The acceleration pattern of the bullet may be freely set, for example: to obtain linear acceleration characteristics, as shown in (1); to accelerate slowly at first and then rapidly, as shown in (2); or to accelerate rapidly at first and then slowly, as shown in (3).

As shown in (4) and (5) of FIG. 6, the variation of the entire length of the helix acceleration barrel 29 enables the adjustment of the acceleration of the bullet 46. Also, the speed of continuous shots and the initial shooting speed of the bullet 46 can be increased by increasing the radius of the acceleration barrel 29.

Figure 7:
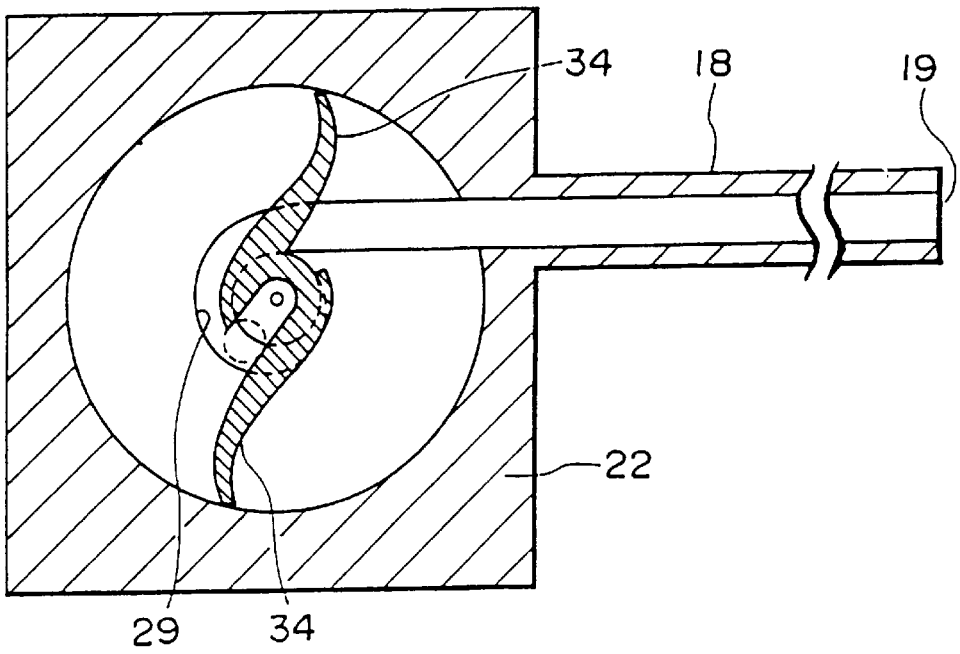
FIG. 7 is a cross sectional view (cut in a plane direction) of the second embodiment of the shooting apparatus of the present invention.
Figure 8:
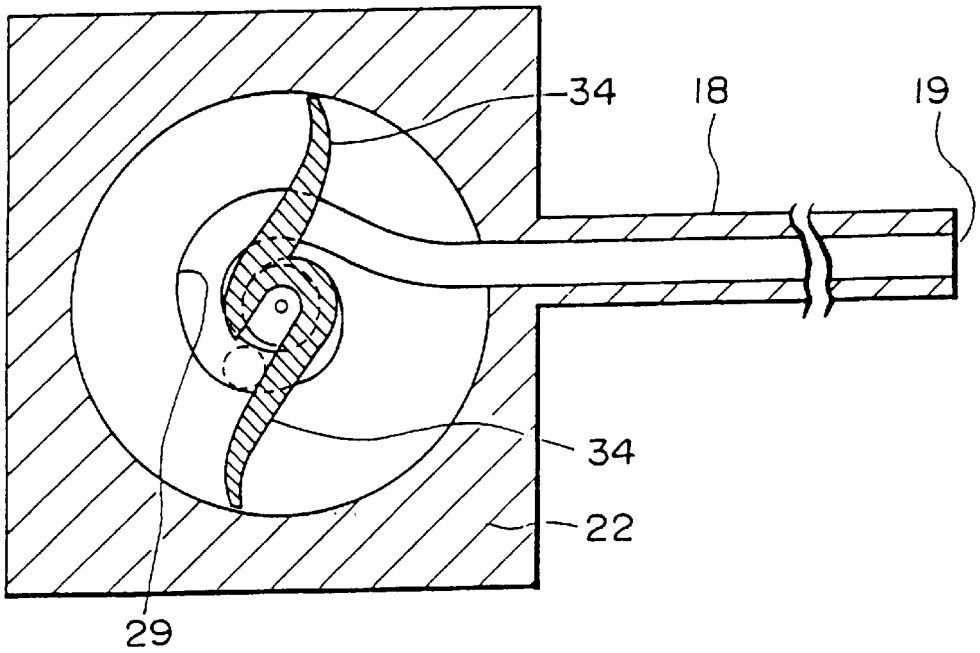
FIG. 8 is a cross sectional view (cut in a plane direction) of the second embodiment of the shooting apparatus of the present invention.

The second embodiment of the present invention is explained below. FIGS. 7 and 8 illustrates the second embodiment of the present invention, wherein the parts used (and descriptions of which) used in the first embodiment bearing the same numerals are omitted. The major difference between the embodiment shown in FIG. 7 and the first embodiment is the structure of the acceleration barrel 29, which comprises a short helix at the section adjacent to the starting point, the radius of curvature of which is smaller than that of the first embodiment, and is a linear shape at the portion adjacent to the bore 19. The major difference between the embodiment shown in FIG. 8 and the first embodiment is the structure of the acceleration barrel 29, which comprises a short helix at the section adjacent to the starting point, the radius of curvature of which is smaller than that in the first embodiment, and is curved at the portion adjacent to the bore 19 away from the helix.

Figure 9:
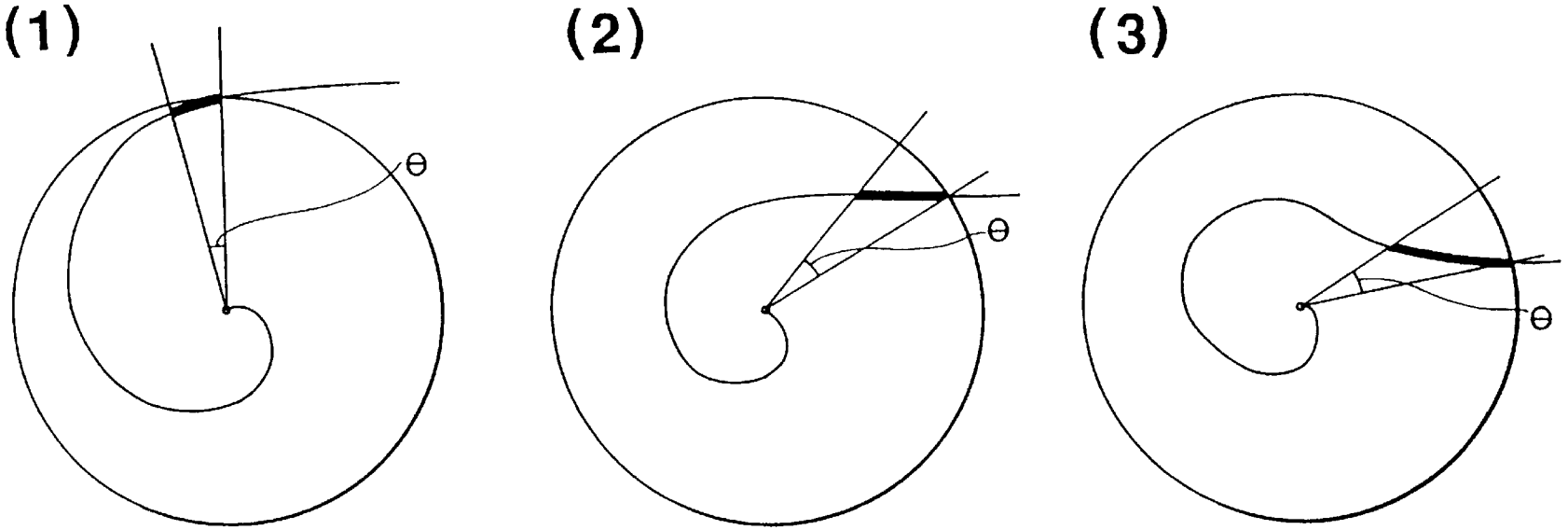
FIG. 9 is a cross sectional view (cut in a plane direction) of the first embodiment of the shooting apparatus of the present invention.

FIG. 9 (1) illustrates the locus of the bullet 46 corresponding to the angular speed of the rotor 34 of the bullet shooting apparatus (shown in FIG. 3) (in the drawing, "θ" shows the angle of rotation of the rotor 34 during one unit-hour). FIG. 9 (2) illustrates the locus of the bullet 46 corresponding to the same angular speed of the rotor 34 of the bullet shooting apparatus (shown in FIG. 7). FIG. 9 (3) illustrates the locus of the bullet 46 corresponding to the same angular speed of the rotor 34 of the bullet shooting apparatus (shown in FIG. 8). As is apparent from FIG. 9, the locus of the bullet 46 in the acceleration barrel 29 according to the second embodiment (i.e., FIG. 9 (2) and (3)) is longer than that of the first embodiment (i.e., FIG. 9 (1)) with the same angular speed. It is also apparent that the locus of the bullet 46 in the acceleration barrel 29 shown in FIG. 8 (i.e., FIG. 9 (3)), is longer than that shown in FIG. 7 (i.e., FIG. 9 (2)). Accordingly, with the acceleration barrel 29 (the acceleration barrel 29 in the shape shown in FIG. 8 in particular), the speed and the power of the bullet 46 can be further increased.

Figure 10:
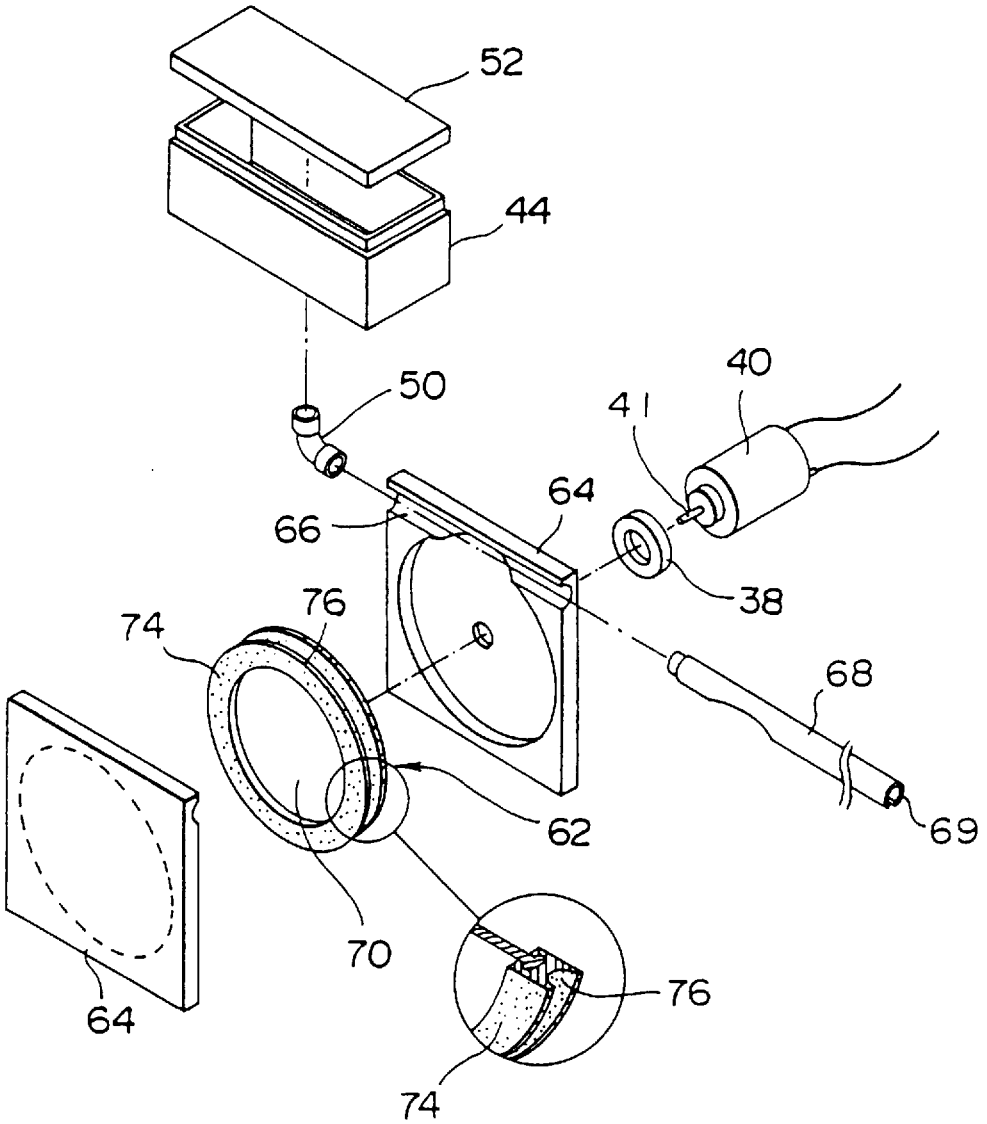
FIG. 10 is an exploded view illustrating the third embodiment of the shooting apparatus of the present invention.
Figure 11:
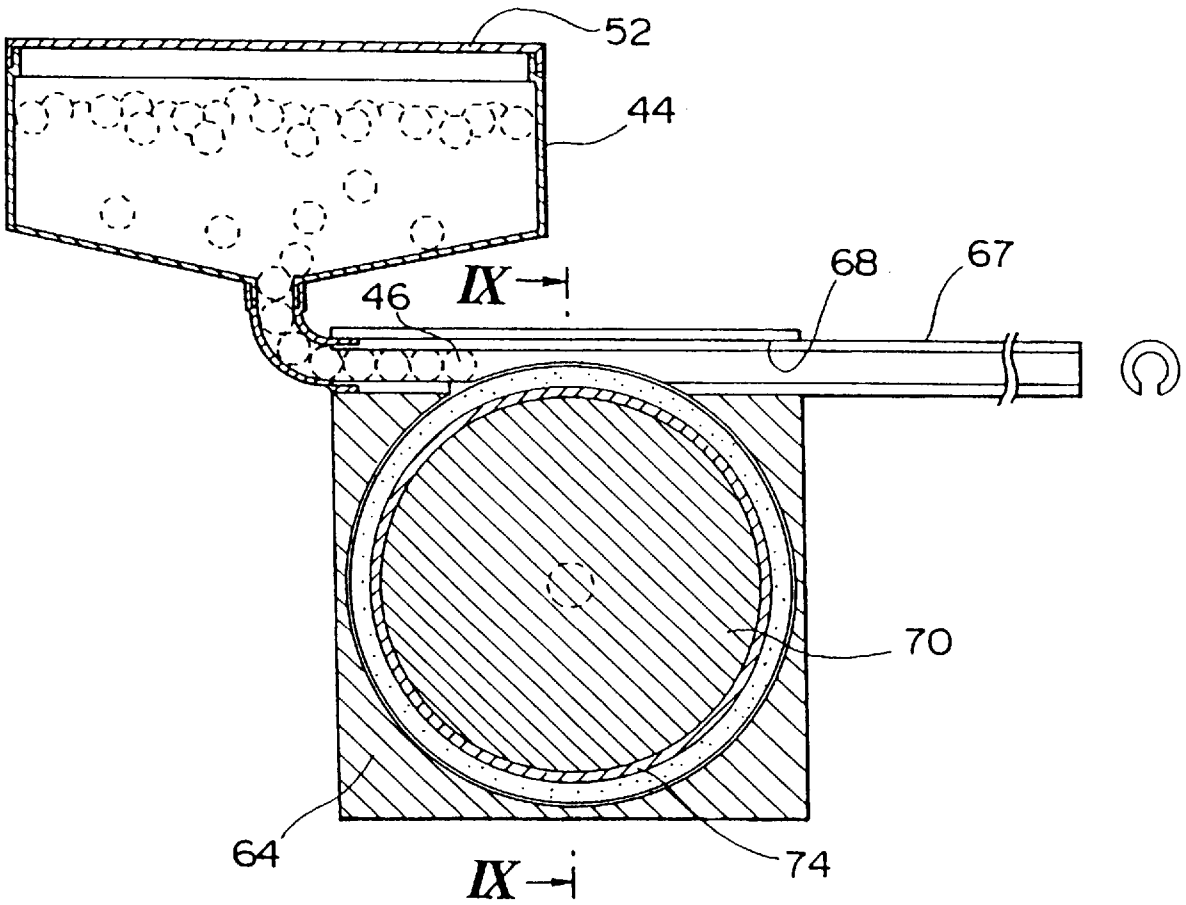
FIG. 11 is a cross sectional view (cut in a plane direction) of the third embodiment of the shooting apparatus of the present invention.
Figure 12:
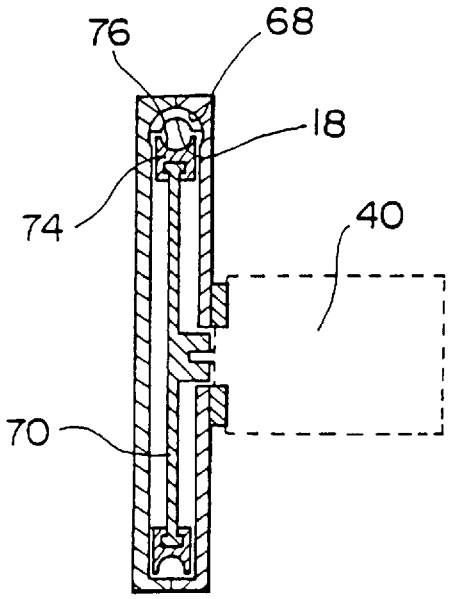
FIG. 12 is a cross sectional view (cut in a plane direction) partly illustrating the third embodiment of the shooting apparatus of the present invention.

The third embodiment of the present invention is explained below, with reference to FIGS. 10 through 12. In the third embodiment, the main body of the shooting apparatus consists of a rotating roller 62 (corresponding to the rotor unit 30 of the first embodiment) and two roller guide plates 64 which holds the rotating roller 62. A concave groove 66 whose cross section is a semi-circle (extending to the direction of the tangent of the rotating roller 62) is formed at the top end portion of each roller guide plate 64, both roller guide plates 64 assembled to form a linear opening 68, the cross section of which is a circle. The shooting barrel 67 is directly in contact with the opening.

The rotating roller 62 consists of a circular wheel 70 and a rubber tire 74 placed around the wheel 70. At the opposite side of the roller guide plate 64, the motor 40 is attached having a spacer 38 in between, and the rotation axis 41 of the motor 40 is secured to the wheel 70, so that the wheel 70 and rotation axis 41 of the motor 40 can rotate in conformity. Furthermore, the toy gun 10 according to the third embodiment has a magazine 44 corresponding to that of the first embodiment, and the bullet 46 stored in the magazine 44 is supplied to the starting end of the opening 68 through the direction changing tube 50.

A curved bend is provided almost exactly in between the opening 68 and the shooting barrel 67 in contact within the opening 68, where the bullet 46 is tentatively held between the upper wall of the opening 68 and the rubber tire 74 of the rotating roller 62, so that the rotating force of the rotating roller 62 can be supplied to the bullet 46 all at the same time. A groove 76 whose cross section is a semi-circle is provided along the entire circumference of the rubber tire 74 to hold the bullet 46. As a result, the bullet 46 is shot from the barrel 67 through the bore 69 at the end of the shooting barrel 67 by the rotating force of the rotating roller 62. In this third embodiment, the rotating force of the rotating roller 62 can be directly applied to the bullet 46, operating similarly to the first embodiment, to launch the bullet.

Figure 13:
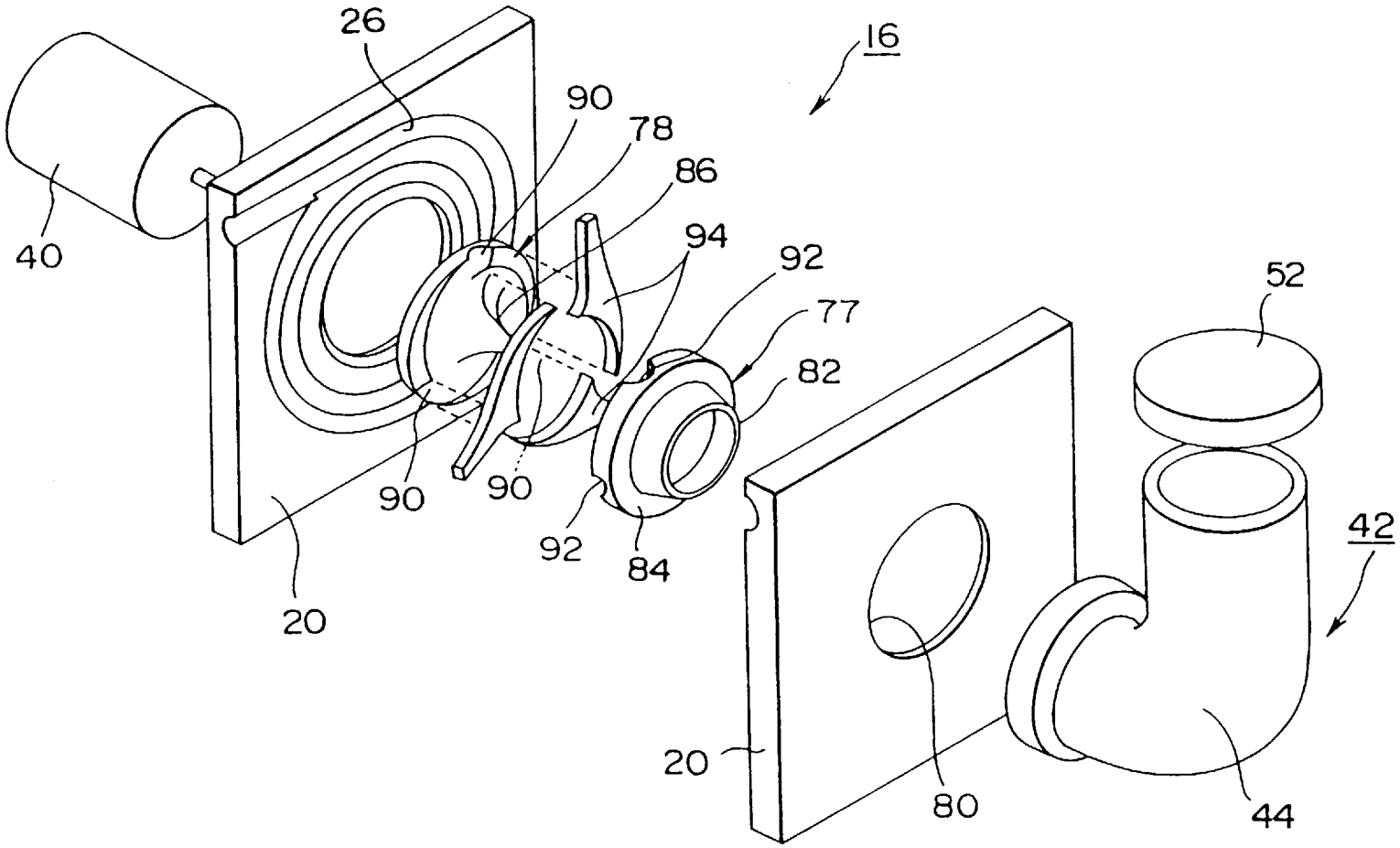
FIG. 13 is an exploded view illustrating the fourth embodiment of the shooting apparatus of the present invention.
Figure 14:
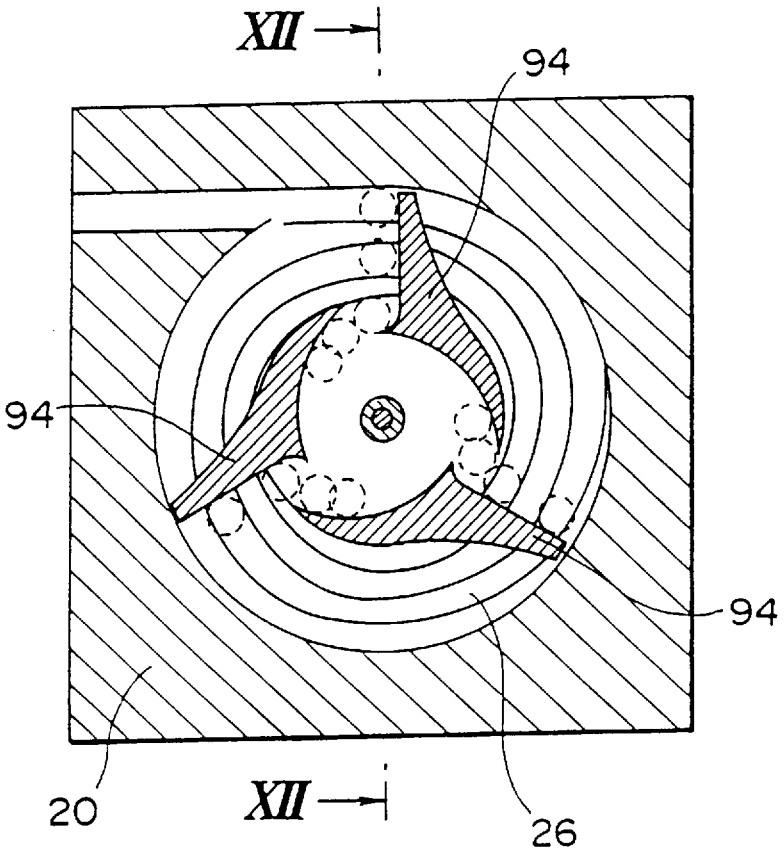
FIG. 14 is a cross sectional view (cut in a plane direction) of the fourth embodiment of the shooting apparatus of the present invention.
Figure 15:
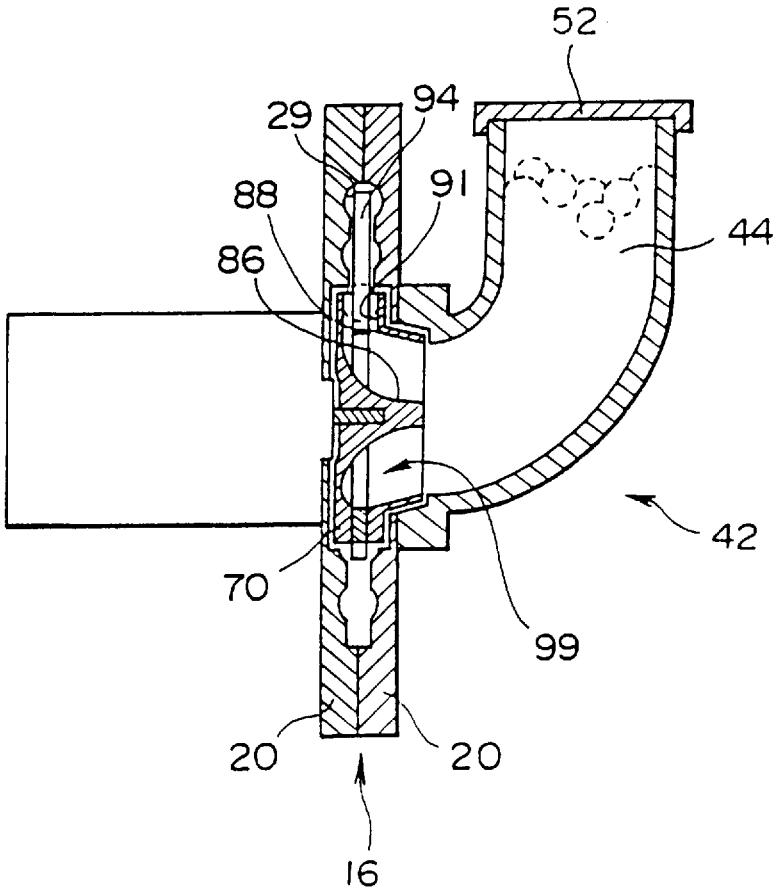
FIG. 15 is a cross sectional view (cut in a plane direction) partly illustrating the shooting apparatus according to the fourth embodiment of the present invention.

The fourth embodiment of the present invention is explained below, with reference to FIGS. 13 through 15. The difference between the forth embodiment and the first embodiment is in the structure of the bullet supply apparatus. Specifically, the bullet supply apparatus according to the fourth embodiment consists of a first center body 77 and a second center body 78, holding three rotor blades 94 in between. The first center body 77 consists of a tapered projection 82 projecting from the opening 80, and a flange 84 extending in the direction of the diameter, when the first center body 77 is assembled to the bullet guide plates 20. A tapered portion 86 projecting towards the first center body 77 is formed at the center of the second center body 78.

When the first center body 77 and the second center body 78 are assembled, recesses 90 are formed on the second center body 78, each at 120 degrees distance, as exits for launching a bullet 46 by centrifugal force, and similar recesses 92 are formed on the first center body 77. Rotor blades 94 in sector form are held between the first center body 77 and the second center body 78. The rotor blades 94 are provided at even 120 degree distances, such that they will not block recesses 90 and 92. The numeral 91 in FIG. 15 illustrates the exit.

When the two bullet guide plates 20 are assembled, the first center body 77, the second center body 78 and the rotor blades 94 are held in rotation within the helix acceleration barrel 29 (26). The magazine 44 of the fourth embodiment inclines at a right angle toward the bullet guide plate 20, and its end portion is attached around the projection 82 of the first center body 77, and the bullet stored in the magazine 44 is supplied to the second center body 78 through the first center body 77.

Figure 16:
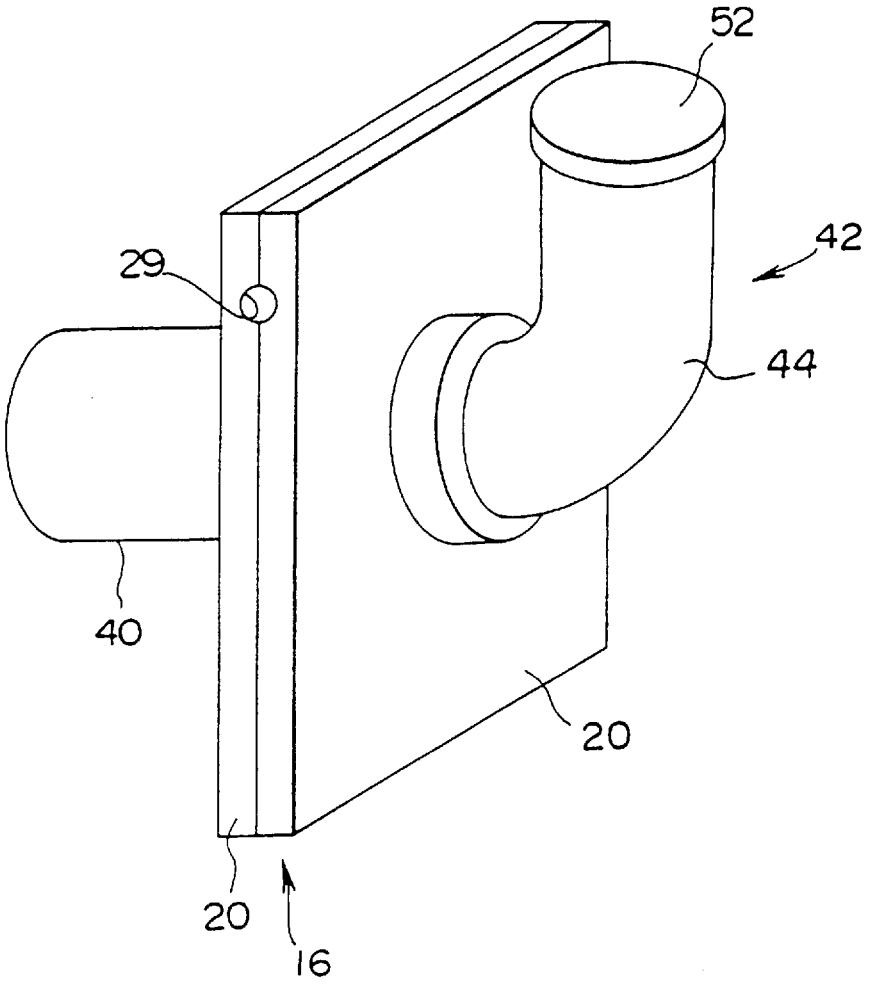
FIG. 16 is a schematic view of the entire shooting apparatus according to the fourth embodiment of the present invention.

FIG. 16 is a perspective view of the entire body of the shooting apparatus according to the fourth embodiment. In FIG. 16, the magazine 44 is provided on one of the two bullet guide plates 20, and the motor 40 for rotating the first center body 77 and the second center body 78 is provided on the opposite side. The terminating end of the acceleration barrel 29 is located on the side surface of the bullet guide plates 20.

The actual operation of the toy gun according to the fourth embodiment is explained below. Assuming that the first center body 77 and the second center body 78 rotates by the rotation of the motor 40, the bullet 46 in the magazine 44 is distributed in the direction of the diameter, in contact with the top end of the tapered portion 86 of the second center body 78, and is ejected to the starting point of the acceleration barrel 89 from each exit 91 by centrifugal force. The ejected bullet 46 is directly pushed into the acceleration barrel 29 by the rotor blade 94 which immediately follows the bullet, wherein the bullet 46 launches out from the terminating end of the shooting barrel 18 through the bore 19.

According to the fourth embodiment, the bullet vessel 99, having a rather large volume, is formed between the first center body 77 and the second center body 78, from which the bullet 46 is ejected through each exit 91 to the acceleration barrel 29. Because the rotor blade 94 pushes the bullet 46 toward each exit 91, the speed of consecutive shots will be three times faster than that of the first embodiment, assuming that the rotating speed of the motor 40 is the same. Also, the bullet 46 is supplied from the magazine 44 to the bullet vessel 99 (having a rather large volume), and thus, lodging of bullets is unlikely. Furthermore, the bullets 46 are equally distributed to each exit 91 once they come into contact with the top of the tapered portion, and then ejected to the acceleration barrel 29, receiving the full rotation force of the motor 40, such that arranging the bullets 46 in one line is unnecessary. Because the bullets 46 are supplied to the acceleration barrel by centrifugal force, the bullets 46 may be supplied smoothly.

Figure 22:
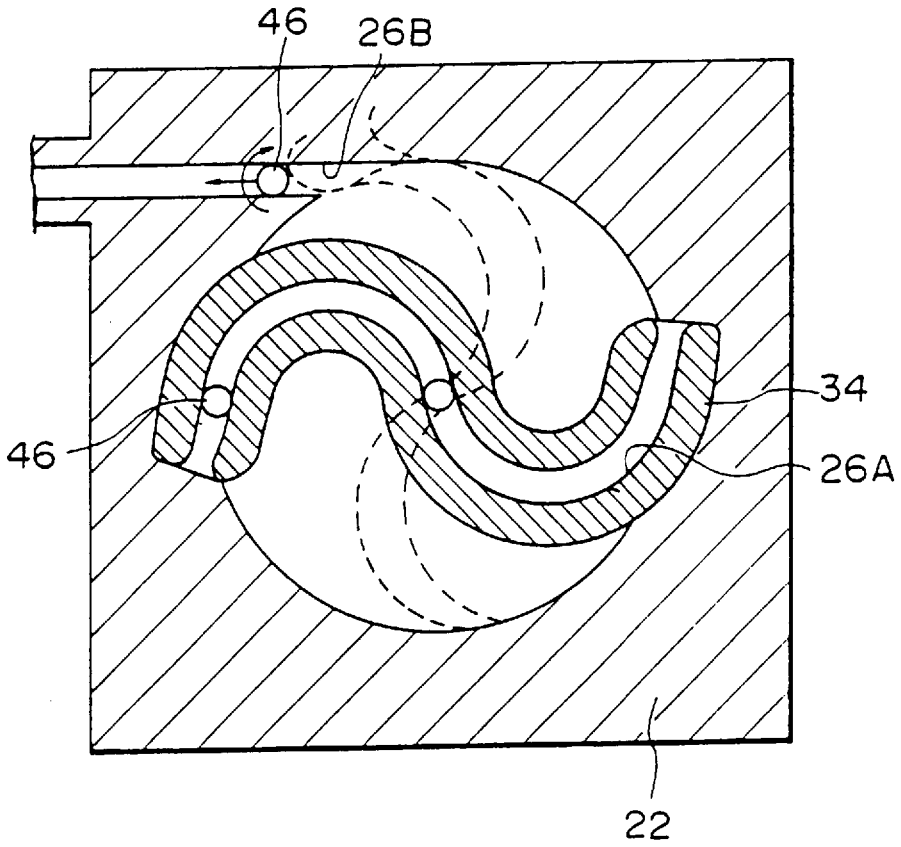
FIG. 22 is a cross-sectional view of a barrel section formed in accordance with an alternative embodiment of the present invention.

In addition to the structure explained in the preceding embodiments, the bullet shooting apparatus according to the present invention may have a structure whereby, for example, as shown in FIG. 22, a groove 56A which may be in communication with the shooting barrel 18 and in which the bullet 46 may pass, is formed on the rotor 34 in a rough S shape, and whereby a rotation means, from the receptacle 58 receives the bullet 46 along the rotor 34 in a longitudinal direction. By rotating the rotor 34, the centrifugal force and rotating force obtained from the rotation of the groove 26A is applied to the bullet 46 passing through this groove, whereby the bullet 46 is accelerated and launched out of the shooting barrel 18. In other words, when the rotor 34 rotates and matches the linear groove 26A continuing to the shooting barrel 18, the groove 26A continuing to the shooting barrel 18, the groove 26A and the groove 26B are in communication with each other, and the bullet 46 can be lead through the groove 26A and the groove 26B to the shooting barrel 18, such that the bullet 46 is launched out of the barrel at a predetermined speed. In short, the rotor 34 (the rotation means) also acts as the acceleration barrel 29, and groove 26A corresponds to groove 26 in the preceding embodiments. According to this rotor 34, the bullet 46 supplied from the receptacle 58, located at the center of the rotor 34, is alternately distributed to both sides of the rotor 34 through the bullet-supplying apparatus 42, and when the rotor 34 rotates 360-degrees, two bullets 46, one from each side of the rotor 34, are launched out.

The rotor 34 shown in FIG. 22 may be structured to block the groove 26A formed from the center to one of the end portions of the rotor 34, and to supply the bullet 46 to the groove 26A formed from the center to the other end portion of the rotor 34. In this case, since it is not necessary to distribute the bullet 46 from the receptacle 58 as described above, it is not necessary to provide a distribution mechanism, and thus it is possible to simplify the structure of the apparatus. When the rotor 34 rotates 360-degrees, one bullet 46 launches from the shooting barrel 18 (from the groove 26A through the groove 26B). Furthermore, the rotor 34 may be formed without the portio in which the groove 26A is blocked, i.e., half of the rough S shape from the center of the rotor 34.

Figure 17:
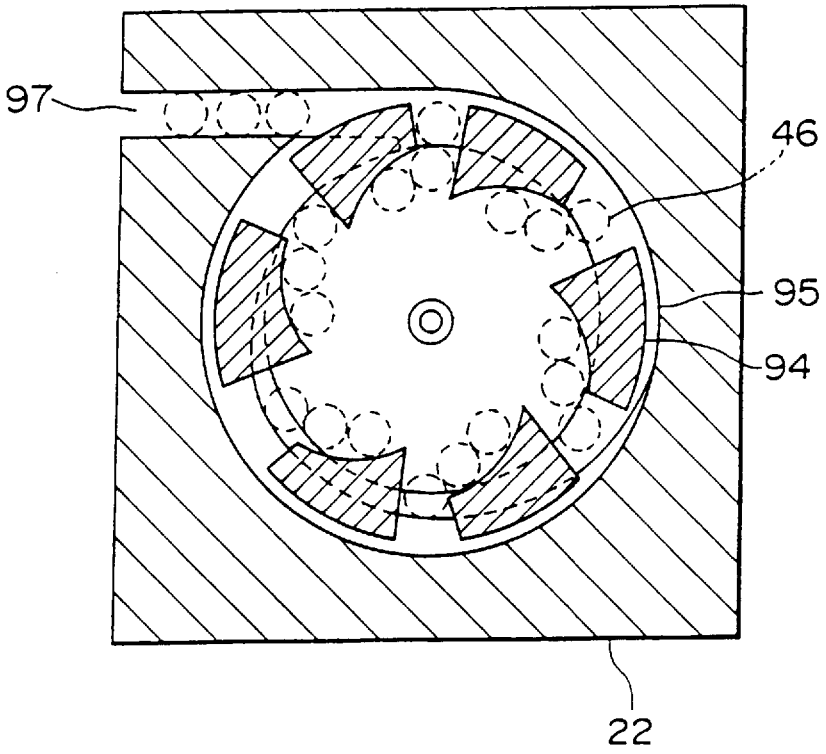
FIG. 17 is a cross sectional view (cut in a plane direction) of the bullet supply apparatus according to the fifth embodiment of the present invention.

The fifth embodiment of the present invention is explained below. FIG. 17 is a plan cross section illustrating the bullet supply apparatus of the present invention. The bullet supply apparatus comprises six recesses 90, 92 and rotor blades 94 as explained in the fourth embodiment. Numeral 95 is the bullet path to guide the bullet 46 from the magazine 44 to the bullet shooting apparatus. The top end 97 of the bullet path 95 can be, for example, connected to the direction changing tube 50 of the first embodiment.

The operation of this bullet supply apparatus is the same as that of the fourth embodiment. In the conventional bullet supply apparatus, the bullets are arranged in the bullet path solely through the drop of bullets, i.e., gravitational force, and thus the bullets may only be introduced to the bullet path in a perpendicular downward direction. However, because the bullet supply apparatus according to the fifth embodiment arranges the bullets 46 in the bullet path by centrifugal force, the bullets 46 may be introduced to the bullet path 95 from any direction. Accordingly, faster and more secure supply of the bullets 46 to the bullet shooting apparatus can be achieved.

Figure 18:
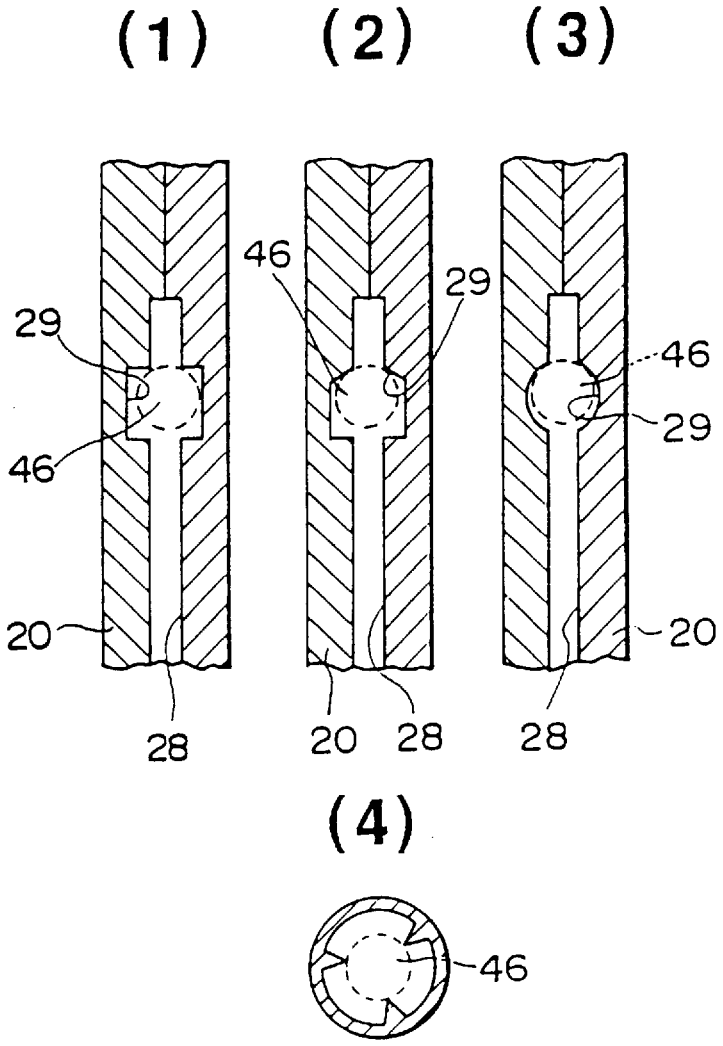
FIG. 18 is a cross sectional view of various barrels.

FIG. 18 illustrates various shapes of the cross section of the acceleration barrel 29: (1) illustrates the cross section of a rectangular shape; (2) illustrates the cross section of a trapezoidal shape; (3) illustrates the cross section of a circular shape. The shape of the cross section of the acceleration barrel 29 is not particularly restricted, but should preferably vary, depending on the material of the bullet 46. In other words, for the shape illustrated in (1), bullets 46 made of a hard material would be preferable, as the contact area is small and friction is low, but bullets 46 made of a soft material would not be preferable, as the edge would cut into the bullet. However, for the shape illustrated in (3), bullets 46 made of a soft material would be preferable, as the edge would not cut into the bullet, but bullets 46 made of a hard material would not be preferable, as the contact area is large and friction is high. The shape illustrated in (2) can be used regardless of the material of the bullet 46. The cross section of the bullet 18 as it is being shot could be the shape illustrated in FIG. 18 (4), in addition to the acceleration barrel 29 illustrated in (1) through (3).

Figure 19:
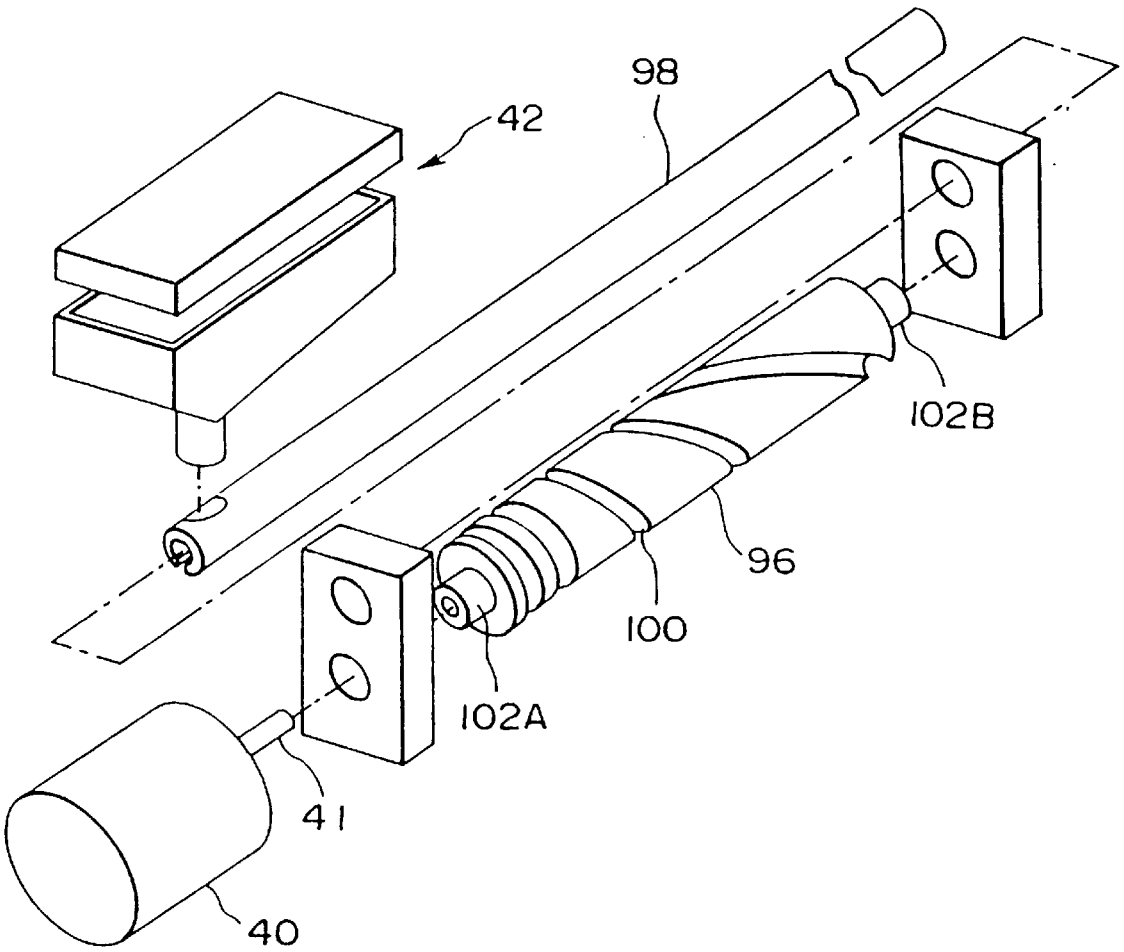
FIG. 19 is a schematic view of the entire shooting apparatus according to the sixth embodiment of the present invention.

The sixth embodiment of the present invention is explained below, with reference to FIGS. 19 and 20. FIG. 19 is a divided assembly view of the bullet shooting apparatus, according to the sixth embodiment of the present invention, and FIG. 20 is the side cross sectional view of the bullet shooting apparatus, according to the sixth embodiment of the present invention.

Figure 20:
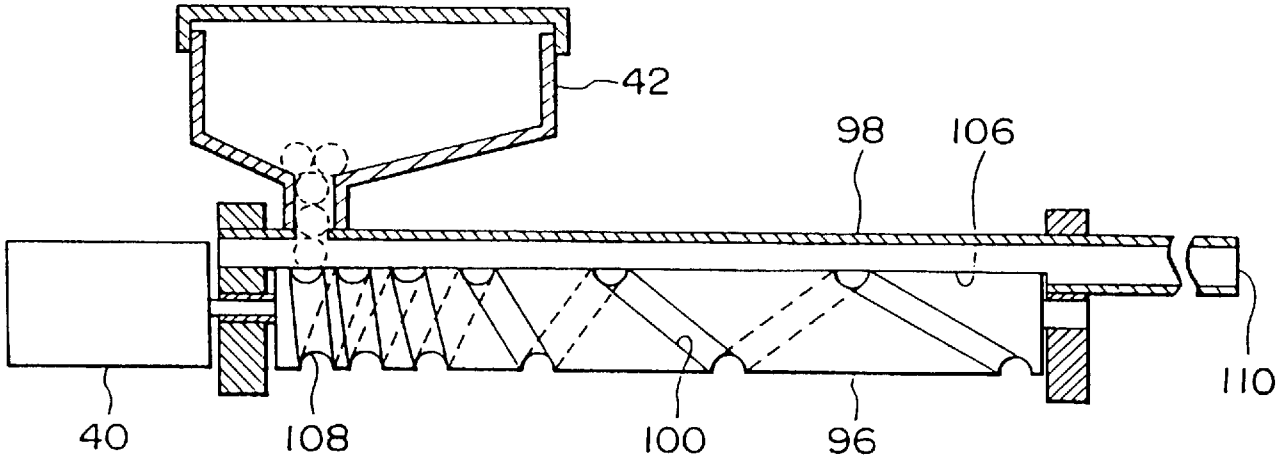
FIG. 20 is a side cross section of the shooting apparatus according to the sixth embodiment of the present invention.

The bullet shooting apparatus illustrated in FIGS. 19 and 20 comprise a rotating drum 96, a motor 40 for rotating the rotating drum 96, a barrel 98 and a bullet supply apparatus 42. The electric circuit of the motor 40 and the bullet supply apparatus 42 of the sixth embodiment is the same as those of the first embodiment.

The rotating drum 96 is a cylindrical shape, and a helix groove 100 is formed on the periphery of the rotating drum in the direction of the rotating drum's circumference. The helix groove 100 is formed to gradually widen from its base portion to its terminating end (bore). An axis end 102A, corresponding to the rotating axis of the rotating drum 96, extends from the base portion of the rotating drum 96 and a similar axis end 102B extends from the terminating end. The axis end 102A at the base portion is connected to the rotating axis 41 of the motor 40, such that the rotating drum 96 rotates in conformity with the rotating axis 41 of the motor 40. As in the first embodiment, the motor 40 is connected to the battery (not shown in the drawing), constructed such that it will supply electricity to the motor 40 when the trigger of the toy gun is pulled, comprising the bullet shooting apparatus.

The barrel 98 is formed in a cylindrical shape, and its inner diameter is slightly larger than the outer diameter of the bullet 46. At the lower portion of the barrel 98, a groove 106 in a rectangular form is formed from the base portion to its longitudinal direction, having a slightly wider width than the diameter of the bullet. The bullet passes between this groove 106 and the groove 100 formed on the rotating drum 96 towards the bore 110. In other words, the bullet 46 is introduced to the side surface of the groove 106 and always passes the distance between the groove 106 and the groove 100 (placed immediately below the groove 106). Also, the bullet supply apparatus 42 is provided at the base portion of the barrel 96, and the bullet 46 is inserted between the groove 106 and the groove 100 by using the bullet supply apparatus 42.

The actual operation of the toy gun comprising the bullet shooting apparatus according to the sixth embodiment is explained below. By pulling the trigger 14 of the toy gun 10, the rotating drum 96 is rotated and, at the same time, the bullet 46 is supplied from the bullet supply apparatus 42 to the space between groove 106 and groove 100. By this rotation, the edge 108 of the groove 100 adjacent to the base portion rotates relative to the bullet 46 supplied. Therefore, the bullet 46 is in contact with the edge 108 of the groove 100 adjacent to the base portion and proceeds along the barrel 98. During this movement, the bullet 46 moves straight along the barrel 98, and from the rotating force of the rotating drum 96 applied to the bullet 46, the bullet 46 moves forward in constant contact with the groove 100, which rotates (due to the rotation of the rotating drum 96 relative to the bullet 46). In other words, the bullet 46 gradually accelerates in the same manner as it passes through the helix groove, and launches from the bore 110 of the barrel 98.

According to the sixth embodiment, integration of the acceleration barrel and the shooting barrel is achieved, unlike the first through fifth embodiments, and a fairly compact body can be obtained for the toy gun. In the sixth embodiment, a rotating drum having a constant diameter is employed, but the embodiment is not restricted, and as such, the rotating drum may be tapered either from the bore or toward the bore.

The apparatus of the sixth embodiment comprises only one rotating drum. However, the embodiment is not limited. For example, several the rotating drum is prepared and provided such that the grooves in each rotating drum faces each other. Thereby, the lateral rotating force applied to the bullet can be set off, in order to prevent the bullet from spinning in the circumference direction of the rotating drum.

Figure 21:
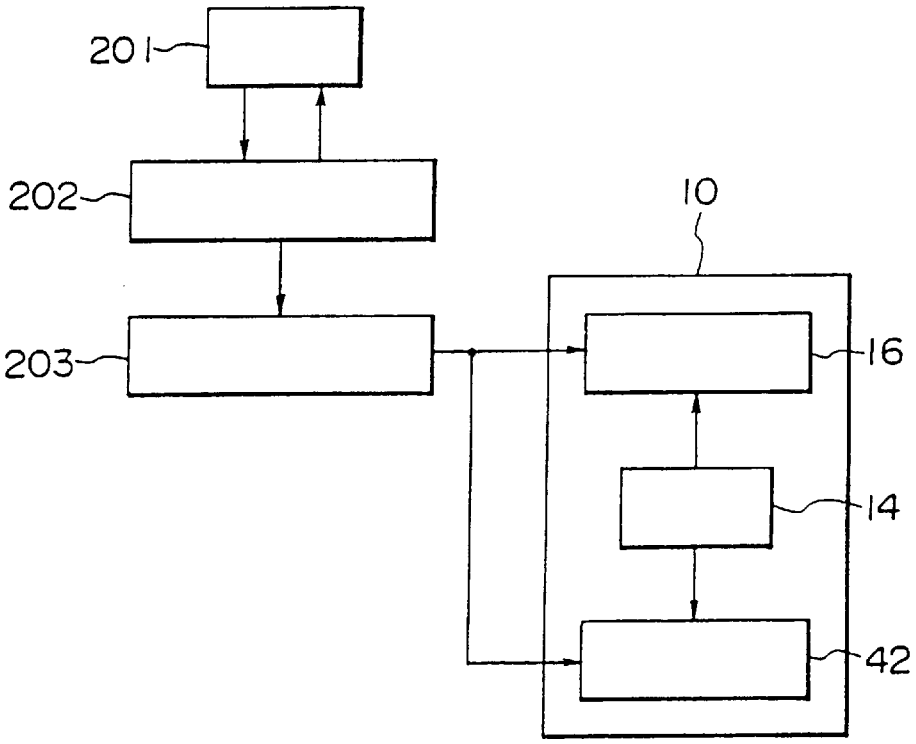
FIG. 21 is a block diagram according to the seventh embodiment of the present invention.

The seventh embodiment of the present invention is explained below, with reference to FIG. 21. FIG. 21 is a block diagram according to the seventh embodiment.

The bullet shooting system illustrated in FIG. 21 comprises a bullet shooting apparatus 16 and a bullet supply apparatus 42 according to the fourth embodiment, and a detection means 202 for detecting (acknowledging) the target 201, and a data processing means 203 for forming a control signal based on the output signal from the detection means 202, and outputting the control signal to the bullet shooting apparatus 16 and bullet supply apparatus 42.

The detection means 202 is configured to comprise: an ultrasonic wave generation part, for the transmission of an ultrasonic wave towards a target 201; a receiving portion for receiving the ultrasonic wave reflected from the target 201; an identifying portion for identifying the location of the target (for example, distance and direction) based on the relationship between the transmission and receiving ultrasonic wave signals; and stored data from micro-computer memory, (all not shown in the drawing). The detection means 202 outputs the signal obtained at the identifying portion (i.e., the signal indicating the location of the target 201) to the data processing means 203.

A micro-computer is installed in the data processing means 203, comprising a data processing portion (not shown in the drawings), to determine the rotation count of the motor 40 based on the output signal from the detection means 202 and the stored data of the micro-computer memory. The data processing means 203 is configured to output the signal obtained from the data processing portion (i.e., desired rotation count) to the motor 40, and to control the rotation count of the motor 40 according to the output signal. In other words, according to this configuration, the rotation count of the rotor blade 94 of the bullet shooting apparatus, and the rotation count of both the first center body 77 and second center body 78 of the bullet supply apparatus 42 shown in FIGS. 13 to 16 can be controlled. For example, when shooting a close target 201, the rotation count is smaller, and when shooting a distant target 201, the rotation count is larger. Thus, when the trigger 14 is pulled, the target 201 can be safely and accurately shot with appropriate power.

The specific operation of the seventh embodiment is explained below. An ultrasonic wave is transmitted from the ultrasonic wave generating portion of the detection means 202 to the target 201, and the receiving portion receives the ultrasonic wave reflected from the target 201, transmitting this received signal to the identifying portion. The identifying portion then identifies the location, speed of movement, shape, size, etc., of the target 201 by an operation based on the signal received from the receiving portion, the relationship between the transmission and the received ultrasonic wave signals that is stored in memory, and the adjustment factor, taking into consideration meteorological data, such as air pressure, wind speed, wind direction and humidity. The signal obtained here (a signal indicating the location of the target 201) is then output to the data processing means 203.

The data processing means 203 then determines the rotation count of the motor 40 by an operation based on the relationship of the signal received from the identifying portion, the signal indicating the location of the target 201 (stored), and the rotation count of the motor 40. In other words, the data processing means 203 determines the rotation count of the rotor blade 94 of the bullet shooting apparatus 16, and the rotation counts of the first center body 77 and the second center body 78 of the bullet supply apparatus 42 shown in FIGS. 13 to 16. According to this operation, the bullet shooting system of the present invention can quickly identify the location of the target 201, supply the bullet 46 from the bullet supply apparatus 42 to the bullet shooting apparatus 16 at the most appropriate supply speed for the target 201, and can accurately launch the bullet 46 towards the target 201 from the bore 19 at the most appropriate speed and power, even though the target 201 might be moving.

The above mentioned operation can be continuously performed, and thus the detection means 202 can always identify the location of the target 201, the data processing means 203 can control the rotation count of the motor 40 based on the detected location, and the bullet shooting system may continuously shoot the bullets 46 at the most appropriate speed and power at any time. Also, shooting with consistent power levels can be achieved, even if targets are located at completely different locations. The bullet is shot with fairly weak power for close targets, such that safety is also improved.

In the seventh embodiment, the detecting means 202 for identifying the location of the target 201 uses ultrasonic waves. However, the scope of this invention is not intended to be limited to this embodiment, and the detecting means of the present invention may also have a sensor or a radar using, for example, radio waves, heat, infrared light, or beams. In addition to the identification of the location of the target, the detection means of the present invention may also predict the moving speed of the target, or identify a condition (shape) of the target through metallic or heat reactions, or image patterns, etc. By way of example, the location or shape of the target hidden behind a shield can be identified by using infrared.

Furthermore, in the seventh embodiment, an example is given whereby the supply speed, shooting speed and power of the bullet 46 is controlled by controlling the rotation count of the motor 40 through the data processing apparatus 203. However, the scope of this invention is not intended to be limited to this embodiment, and it is possible to control the rotating force applied to the bullet 46 by controlling the installation angle of the acceleration barrel 29 to the shooting barrel 18, i.e., the angle formed between the groove 26 on the acceleration barrel 29 and the shooting barrel 18, according to the signal received from the detection means 202. In that case, it is possible to cause the bullet 46 to trace a curved trajectory, and thus it is possible to shoot a target hidden behind a shield by using infrared as a detection means.

Furthermore, in the seventh embodiment, the example is given of providing the detection means and the data processing means on the toy gun 10 according to the fourth embodiment (i.e., a bullet shooting system). However, the scope of this invention is not intended to be limited to this embodiment, and the detection means and the data processing means of the present invention can, of course, be applied to the toy gun according to other embodiments.

In the above embodiments, a toy gun is used as an example for purposes of explaining the bullet supply system comprising the bullet shooting apparatus and the bullet supply apparatus of the present invention. However, the scope of this invention is not intended to be limited to toy guns, and the present invention may be widely applied to any apparatus for continuously shooting several bullets. For example, the present invention can be applied to a paint shooting gun wherein paint is encapsulated in a spherical film used as a bullet.

Also, the bullet shooting apparatus, the bullet supply apparatus and the bullet supply system which comprise the above apparatuses of the present invention can also be applied to an actual pistol. The motor used in a car can be used as power source for shooting the bullet.

In this embodiment, a bullet shooting apparatus 16 comprising only one acceleration barrel 29 is explained, however, the scope of this invention is not intended to be limited to this embodiment, and the bullet supply apparatus of the present invention may comprise several acceleration barrels with different shapes or sizes. In such case, a magazine for supplying a bullet comprising a shape and size suitable for each of the acceleration barrels should preferably be provided, such that the size and type of the bullet can easily be selected without changing the toy guns, according to the speed and power required, in accordance with the target. When the function of selecting the magazine and the acceleration barrel according to the signal obtained from the detection means is provided at the data processing means, the apparatus may automatically select and shoot the most appropriate bullet.

The bullet shooting apparatus and the bullet supply apparatus of the present invention may be separately used.

Accordingly, the present invention can provide a bullet shooting apparatus which shoots a bullet at a higher consecutive shooting speed, and higher initial shooting speed, than those of the prior art, without using compressed gas, and without resulting in energy loss. Also, the energy loss which is required for shooting the bullet is limited, such that a bullet shooting apparatus with a longer bullet flying distance can be provided.

Furthermore, the rotating force of the bullet introduction rotating means can be applied to the bullet, such that a bullet supply apparatus capable of promptly and accurately introducing the bullet to the bullet shooting apparatus can be provided.

The series of operations, from supplying the bullet to launching the bullet, can be effectively performed, and the synergism between the two apparatuses can improve the operations, by incorporating the bullet shooting apparatus and the bullet supply apparatus of the present invention.

The bullet shooting system of the present invention comprises a detection means for detecting the target, and a data processing means for forming a control signal based on the output signal from the detection means, outputting such control signal to the rotating means, such that the bullet can be shot accurately, and at a constant power, regardless of the type or location of the target.

What is claimed is:

1. A bullet shooting apparatus comprising:

a barrel having a bore formed therein with a supply opening formed at one end and a discharge opening formed at the other end, said barrel having a longitudinal axis, a first curved portion starting adjacent said supply end of said bore and terminating near said discharge end and a second curved portion beginning where said first curved portion terminates and extending adjacent said discharge end, said second curved portion curving in a direction substantially opposite to the direction of said first curved portion;

a bullet supply mechanism for supplying a bullet within said bore in said barrel; and a launching means positioned in said barrel for launching the bullet out of the bore of the barrel by directly pushing the bullet.

2. The bullet shooting apparatus according to claim 1 wherein said first curved portion comprises a helix.

3. The bullet shooting apparatus according to claim 2, wherein said second curved portion comprises an arcuate portion.

4. The bullet shooting apparatus according to claim 2, wherein said helix-shaped first curved portion comprises a logarithmic spiral.

5. The bullet shooting apparatus according to claim 1, wherein said bullet supply mechanism supplies the bullet to said supply end of said bore in said barrel.

6. A bullet shooting apparatus according to claim 1, said bullet supply mechanism comprising a rotating vessel with an opening, the diameter of which increases the closer it is to the barrel, and which is connected to the barrel; the bullet in said vessel being supplied to the barrel through said opening.

7. A bullet shooting apparatus according to claim 1, wherein said launching means comprises a cylindrical rotating drum that rotates around said longitudinal axis of said barrel, and a groove provided on the periphery of said rotating drum, being connected to said bore, and into which the bullet can be inserted.

8. A bullet shooting apparatus according to claim 7, said groove comprising a helix, the diameter of which increases towards the direction of the bore.

9. A bullet shooting apparatus according to claim 8, said rotating drum tapering from either end.

10. A bullet shooting apparatus according to claim 8, comprising of several of said rotating drums, the grooves of each of said rotating drums facing each other.

11. The bullet shooting apparatus according to claim 1, further comprising a bullet supply apparatus comprising:

a magazine;

a bullet path to guide a bullet from said magazine to said bullet shooting apparatus; and a bullet introduction rotating means, which rotates and introduces the bullet from said magazine to said bullet shooting apparatus through said bullet path.

12. A bullet supply apparatus according to claim 11, said bullet introduction rotating means comprising a rotating vessel, and an opening provided on said vessel, the diameter of said opening increases the closer it is to the bullet path and which is in communication with the bullet path, wherein the bullet in said vessel is supplied to the bullet path through said opening.

13. A bullet supply apparatus according to claim 12, comprising several said openings.

* * * * *